US006224467B1

(12) United States Patent
Tanaka et al.

(10) Patent No.: US 6,224,467 B1
(45) Date of Patent: May 1, 2001

(54) METHOD OF PRODUCING OCULAR LENS AND HOLDERS FOR HOLDING LENS BLANK DURING CUTTING THEREOF

(75) Inventors: Yuki Tanaka, Nagoya; Yasuyoshi Yamamoto, Komaki; Masahiro Sasaki, Konan; Toshikazu Miura; Seiichi Ichikawa, both of Kakamigahara; Hiroyuki Tajima, Gifu-ken, all of (JP)

(73) Assignee: Menicon Co., Ltd., Nagoya (JP)

( * ) Notice: Subject to any disclaimer, the term of this patent is extended or adjusted under 35 U.S.C. 154(b) by 0 days.

(21) Appl. No.: 09/121,573

(22) Filed: Jul. 23, 1998

(30) Foreign Application Priority Data

Jul. 31, 1997 (JP) ..... 9-206743

(51) Int. Cl.[7] ..... B24B 1/00
(52) U.S. Cl. ..... 451/42; 451/388; 451/390
(58) Field of Search ..... 451/42, 364, 384, 451/388, 390, 397, 398

(56) References Cited

U.S. PATENT DOCUMENTS

| | | | | |
|---|---|---|---|---|
| 3,833,230 | * | 9/1974 | Noll | 279/3 |
| 3,886,696 | * | 6/1975 | Bruck | 51/216 LP |
| 4,184,292 | * | 1/1980 | DeFazio et al. | 51/235 |
| 5,284,348 | | 2/1994 | Tanaka et al. . | |
| 5,291,692 | * | 3/1994 | Takahashi et al. | 51/235 |
| 5,474,489 | | 12/1995 | Vernon . | |
| 5,494,474 | | 2/1996 | Vernon . | |
| 5,567,198 | * | 10/1996 | Cook | 451/384 |
| 5,951,375 | * | 9/1999 | Mandler | 451/42 |

FOREIGN PATENT DOCUMENTS

| | | |
|---|---|---|
| 1-101319 | 1/1989 | (JP) . |
| 7-195556 | 8/1995 | (JP) . |

* cited by examiner

*Primary Examiner*—Timothy V. Eley
*Assistant Examiner*—Dung Van Nguyen
(74) *Attorney, Agent, or Firm*—Burr & Brown

(57) ABSTRACT

A method of producing an ocular lens, comprising the steps of: (a) preparing a lens blank which gives an ocular lens, the lens blank having a concave back surface and a convex front surface, at least a portion of the front surface being tapered to give a tapered surface; (b) forming a back curved surface of the ocular lens by effecting a cutting operation on the concave back surface of the lens blank, while the lens blank is supported on a spindle of a back surface cutting device such that the tapered surface of the lens blank is drawn onto a tapered holding surface of the spindle under a negative pressure applied to the lens blank, the tapered holding surface following a profile of the tapered surface of the lens blank; and (c) forming a front curved surface of the ocular lens by effecting a cutting operation on the front surface of the lens blank whose back surface has been cut to form the back curved surface, while the lens blank is supported on a spindle of a front surface cutting device such that the back curved surface of the lens blank is drawn onto a holding surface of the spindle of the front surface cutting device under a negative pressure applied to the lens blank.

20 Claims, 7 Drawing Sheets

METHOD OF PRODUCING OCULAR LENS AND HOLDERS FOR HOLDING LENS BLANK DURING CUTTING THEREOF

The present application is based on Japanese Patent Application No. 9-206743 filed Jul. 31, 1997, the content of which is incorporated hereinto by reference.

BACKGROUND OF THE INVENTION

1. Field of the Invention

The present invention relates to a method of producing an ocular lens such as a contact lens or an intraocular lens, and lens blank holders and a lens blank loader/unloader, which are used in producing the ocular lens. More specifically, the present invention is concerned with such a method of producing an ocular lens by effecting cutting operations on a lens blank which gives one ocular lens, so that the produced ocular lens has desired front and back curved surfaces. The invention also relates to lens blank holders for holding the lens blank, by which the lens blank is supported on a front and a back surface cutting device during the cutting operations on the lens blank for forming an intended ocular lens having the back and the front curved surfaces. The invention also relates to a lens blank loading and unloading device for loading and unloading the lens blank on and from the front or back surface cutting device.

2. Discussion of the Related Art

In a conventional method of producing an ocular lens as disclosed in JP-A-1-101319 and JP-A-7-195556, for instance, a lens blank formed of a suitable material and having a size that gives an ocular lens is bonded to a lens blank holder, which is in turn attached to a spindle of a cutting device, so that the lens blank is machined for forming the intended ocular lens having a back and a front curved surface. In this method, one of the opposite surfaces of the lens blank is first machined while the other surface is bonded to the lens blank holder. Subsequently, the lens blank is removed from the lens blank holder, and the above-indicated other surface which has been bonded to the lens blank holder is then machined while the above-indicated one surface which has been machined is bonded to the lens blank holder. Thus, the opposite surfaces of the lens blank are machined to give the desired back and front curved surfaces of the ocular lens.

In the method indicated above, however, it is required to bond the lens blank to the blank holder, remove the lens blank therefrom, and clean the lens blank to remove the bonding agent after each of the opposite surfaces of the lens blank has been subjected to the cutting operation. Accordingly, the above method is cumbersome and time-consuming, resulting in low production efficiency of the ocular lens. The cutting operations on the lens blank need to be effected by taking account of the thickness of a layer of the bonding adhesive applied between each surface of the lens blank and the blank holder. However, it is difficult to effect the cutting operations on the lens blank for forming the ocular lens with high accuracy while accurately controlling the thickness of the adhesive layer. In some cases, the thickness of the obtained ocular lens may vary due to a variation of the thickness of the layer of the adhesive applied between the lens blank surface and the lens blank holder.

When the lens blank is bonded to the blank holder, the axis of the lens blank needs to be accurately positioned relative to the axis of the spindle of the cutting device, so that the produced lens has an optical axis. However, no technique has been established for assuring accurate and easy positioning of the lens blank relative to the blank holder when the lens blank is bonded to the lens blank holder. It is accordingly difficult to accurately position the lens blank relative to the spindle of the cutting device.

SUMMARY OF THE INVENTION

It is therefore an object of the present invention to provide a method of producing an ocular lens by effecting cutting operations on a lens blank. It is also an object of the present invention to provide lens blank holders and a lens blank loading and unloading device, which can be suitably used in producing the ocular lens.

More specifically described, it is a first object of the present invention to provide a method of producing an ocular lens from a lens blank, which permits easy attachment and removal of the lens blank to and from a spindle of a front or a back surface cutting device, so as to assure accuracy of positioning of the lens blank relative to the spindle for producing the ocular lens having an intended optical characteristic, with high accuracy and production efficiency.

It is a second object of the present invention to provide a lens blank holder for holding a lens blank during a back surface cutting operation of the blank, which lens blank holder permits the lens blank to be supported on a spindle of a back surface cutting device with high positioning accuracy, while permitting easy attachment and removal of the lens blank to and from the spindle, so that an intended ocular lens having a desired back curved surface is produced with ease and high precision.

It is a third object of the present invention to provide a lens blank holder for holding an intermediate lens blank during a front surface cutting operation of the lens blank whose back surface has been cut to form the back curved surface of an ocular lens, which lens blank holder permits the intermediate lens blank to be supported on a spindle of a front surface cutting device with high positioning accuracy, while permitting easy attachment and removal of the intermediate lens blank to and from the spindle, so that the intended ocular lens having a desired front curved surface is produced with ease and high precision.

It is a fourth object of the present invention to provide a lens blank loading and unloading device for loading and unloading a lens blank on and from a spindle of a surface cutting device, which device permits the lens blank to be easily supported on the spindle of the cutting device with high positioning accuracy and to be easily removed from the cutting device.

The above first object of the present invention may be attained according to a first aspect of the invention, which provides a method of producing an ocular lens, comprising the steps of: (a) preparing a lens blank which gives an ocular lens, the lens blank having a concave back surface and a convex front surface, at least a portion of the front surface being tapered to give a tapered surface; (b) forming a back curved surface of the ocular lens by effecting a cutting operation on the concave back surface of the lens blank, while the lens blank is supported on a spindle of a back surface cutting device such that the tapered surface of the lens blank is drawn onto a tapered holding surface of the spindle under a negative pressure applied to the lens blank, the tapered holding surface following a profile of the tapered surface of the lens blank; and (c) forming a front curved surface of the ocular lens by effecting a cutting operation on the front surface of the lens blank whose back surface has been cut to form the back curved surface, while the lens blank is supported on a spindle of a front surface cutting device such that the back curved surface of the lens blank is drawn onto a holding surface of the spindle of the front surface cutting device under a negative pressure applied to the lens blank.

In the method described above, the lens blank is subjected to cutting operations for forming the front and back curved surfaces of the intended ocular lens, with the lens blank being supported or held on the spindle of the front and back surface cutting devices with a suction force, i.e., under a negative pressure applied to the lens blank. According to this method, the lens blank can be easily and quickly attached to and removed from the front or back surface cutting device, so as to assure a significantly improved production efficiency of the ocular lens, as compared with the conventional method in which the lens blank is bonded with an adhesive to a suitable device adapted to hold the lens blank during the cutting operations.

In the present method, the lens blank can be positioned relative to the spindle of the back surface cutting device such that the tapered surface of the front surface of the lens blank is drawn onto the tapered holding surface provided on the side of the spindle of the front surface cutting device. Accordingly, the axis of the lens blank can be precisely and easily positioned relative to the axis of the spindle of the cutting device. In other words, the present method allows easy alignment of the optical center of the back curved surface of the ocular lens to be obtained, with respect to the axis of the spindle of the cutting device, while assuring excellent production efficiency. It is preferable to determine the taper angles of the tapered surface of the lens blank and the tapered holding surface of the back surface cutting device such that the configuration of the lens blank is as similar as possible to that of the intended ocular lens, for saving the required amount of the lens material to be used and for improving the efficiency of the cutting operations. In order to provide a sufficient force for holding the lens blank in place on the tapered holding surface of the spindle, the taper angles of the tapered surface of the lens blank and the tapered holding surface provided on the spindle of the back surface cutting device are preferably selected within a range of 80°–160°, more preferably 100°–140°.

According to the present method, the back curved surface of the intermediate lens blank is drawn onto the spindle of the front surface cutting device by a negative pressure. In this case, since the intermediate lens blank is drawn directly onto the holding surface of the front surface cutting device without an adhesive layer interposed therebetween, the lens blank can be formed into the intended ocular lens with high dimensional accuracy, with a high degree of control accuracy of the thickness of the lens blank.

The lens blank used in the present invention may be obtained by cutting a bar-shaped contact lens material which is obtained from polymerization of a monomer liquid in a test tube, so that the lens blank has a suitable axial dimension. Alternatively, a mold is used for forming the lens blank, which mold has a mold cavity having a size that gives an ocular lens. In this case, the lens blank is formed concurrently with the polymerization of the monomer liquid which fills the mold cavity. For easily aligning the optical center of the front surface of the lens blank with the axis of the spindle of the back surface cutting device, at least a portion of the front surface of the lens blank is tapered. For instance, the tapered surface is formed at a radially inward, outward, or intermediate portion of the front surface of the lens blank.

The lens blank used in the present invention has a profile or configuration similar to that of the intended ocular lens, namely, the lens blank has a concave back surface and a convex front surface corresponding to those of the intended ocular lens. This arrangement requires a reduced amount of stock removal of the lens blank during the cutting operations, than where the ocular lens is fabricated by cutting a cylindrical lens blank, to thereby assure improved cutting efficiency and reduction of the required amount of the lens material to be used.

In a first preferred form of the above first aspect of the present invention, the lens blank includes a flat surface formed at a central portion of the front surface thereof, which flat surface is perpendicular to an axis of the lens blank. According to this arrangement, the configuration of the lens blank is similar to that of the intended ocular lens, resulting in further improved efficiency of the cutting operations and considerable reduction of the required amount of the lens material.

The above second object of the present invention may be attained according to a second aspect of the invention, which provides a lens blank holder for holding a lens blank which gives an ocular lens during a cutting operation on a concave back surface of the lens blank to form a back curved surface of the ocular lens, the lens blank further having a convex front surface at least a portion of which is tapered to give a tapered surface, the lens blank holder having a concave holding surface for contact with the front surface of the lens blank for holding the lens blank thereon, the lens blank holder being mounted on a back surface cutting device for cutting the concave back surface of the lens blank, so that the lens blank is supported on the back surface cutting device, the lens blank holder comprising: a first portion having a tapered holding surface which gives at least a portion of the concave holding surface and which follows a profile of the tapered surface of the convex front surface of the lens blank, the lens blank being positioned relative to the lens blank holder such that the tapered surface of the lens blank contacts the tapered holding surface of the lens blank holder; and a second portion having at least one air passage which is open in the concave holding surface, the convex front surface of the lens blank being drawn onto the concave holding surface under a negative pressure applied through the at least one air passage.

In the lens blank holder constructed as described above, the tapered surface of the lens blank is brought into contact with the tapered holding surface of the lens blank holder, so that the axis of the lens blank is easily and accurately brought into position with respect to the lens blank holder while at the same time the lens blank is prevented from moving out of position due to an external force applied thereto during the cutting operation, whereby the lens blank is effectively kept in position during the cutting operation. Further, the lens blank is drawn directly onto the concave holding surface of the lens blank holder under a negative pressure applied thereto, without a bonding adhesive layer interposed therebetween. This arrangement permits easy attachment and removal of the lens blank to and from the lens blank holder while precisely positioning the lens blank relative to the lens blank holder in the axial direction as well as the radial direction. Therefore, with the present lens blank holder being mounted on the spindle of the back surface cutting device, the lens blank can be advantageously supported by the lens blank holder on the spindle of the back surface cutting device, to thereby improve efficiency and working accuracy of the cutting operation for forming the back curved surface of the ocular lens.

The configuration and number of the at least one air passage through which the negative pressure is applied to the lens blank are not particularly limited, provided that each air passage is open in the tapered holding surface of the lens blank holder for applying a suction force of the negative pressure to the lens blank which is placed on the tapered holding surface. For instance, the at least one air passage is a single air passage which is open in a central portion of the tapered holding surface. Alternatively, the at least one air passage may be a single or a plurality of annular slits, or a plurality of arcuate or circular holes which are spaced apart from each other at a suitable interval in the circumferential direction of the tapered holding surface. Further, at least a portion of the above-indicated second portion which is adjacent to the tapered holding surface may be formed of a porous metal material, a porous ceramic material or a porous resin material, so as to provide a multiplicity of minute pores or openings which are open in the tapered holding surface. The cross sectional shape of each air passage may be circular, rectangular, or star-shaped, for instance.

In a first preferred form of the above second aspect of the invention, the concave holding surface for contact with the convex front surface of the lens blank has a frictional area which is formed of a material having a friction coefficient higher than that of the other area of the concave holding surface, so that the frictional area functions as a fixing surface for preventing displacement of the lens blank.

According to this arrangement, the concave holding surface partially functions as the frictional area or fixing surface. In this case, the above-indicated other area of the concave holding surface is formed of a material that exhibits rigidity sufficient for holding the lens blank while preventing deformation thereof during the cutting operation. On the other hand, the frictional area or fixing surface is formed of a material that generates a sufficient friction force to prevent displacement of the lens blank during the cutting operation, so as to hold the lens blank in a predetermined position. In this arrangement, the lens blank is kept drawn onto the concave holding surface of the lens blank holder with high stability during the cutting operation for forming the back curved surface of the ocular lens while the lens blank is prevented from being deformed. Accordingly, the obtained ocular lens does not suffer from any deficiencies which arise from otherwise possible deformation and displacement of the lens blank, thereby improving cutting accuracy and stability in forming the back curved surface of the ocular lens.

The tapered holding surface need not be formed over the entire area of the concave holding surface, and may be formed at any part of the concave holding surface, as long as the tapered holding surface can be brought into abutting contact with the tapered surface of the lens blank for permitting easy positioning of the lens blank. The material of a non-frictional portion of the lens blank holder that gives the above-indicated other area of the concave holding surface and the material of a frictional portion that gives the frictional area are not particularly limited, but are suitably determined by taking account of the formability and the material of the other portions of the lens blank, for example. It is preferable to use, as the material of the non-frictional portion, a highly rigid material such as a metal, or a synthetic resin material such as an acrylic resin material which includes PMMA, polystylene, polyester, polycarbonate or ABS resin, for instance. On the other hand, the material of the frictional portion is suitably selected from a synthetic resin material such as a soft vinyl chloride resin, nylon or polyurethane, and an elastic material such as a silicone rubber or a fluoro rubber, all of which have an elastic coefficient lower than the material of the non-frictional portion, and a high friction coefficient so as to generate a large friction force with respect to the lens blank. For improving productivity and reducing the weight and the manufacturing cost of the lens blank holder, it is particularly preferable to use PMMA for the non-frictional portion and the soft vinyl chloride resin for the frictional portion.

In a second preferred form of the above second aspect of the present invention, the fixing surface is located at an outer peripheral portion of the concave holding surface. This fixing surface may extend continuously or discontinuously in the circumferential direction of the concave holding surface. That is, the fixing surface may consist of a single annular area or a plurality of areas which are spaced from each other in the circumferential direction of the concave holding surface. Generally, the outer peripheral portion of the ocular lens has a comparatively small optical importance than the central portion. In view of this, the central portion of the lens blank which is required to exhibit highly accurate optical characteristics is desirably held in contact with the corresponding central portion of the concave holding surface of the lens blank holder, which central portion is formed of a highly rigid material for the purpose of preventing the deformation of the lens blank, to thereby permit accurate cutting operation on the lens blank. On the other hand, the outer peripheral portion of the lens blank which is less likely to effect the optical characteristics of the obtained ocular lens is desirably held in contact with the fixing surface of the concave holding surface, which is formed of a material having a low elastic coefficient and a high friction coefficient, so that the lens blank is held in position by the fixing surface with high stability.

In a third preferred form of the above second aspect of the present invention, the concave holding surface includes a recessed central portion, and the tapered holding surface which surrounds the recessed central portion contacts the front surface of the lens blank.

In the lens blank holder constructed as described above, the recessed portion is formed at the central portion of the concave holding surface, and the front surface of the lens blank is spaced away from the the recessed central portion with a suitable spacing left therebetween when the lens blank is drawn onto the concave holding surface. This spacing between the central portion of the front surface of the lens blank and the recessed central portion of the concave holding surface is effective to accommodate or absorb any dimensional error (thickness variation, in particular) of the lens blank, so that only the tapered surface of the lens blank contacts the tapered holding surface surrounding the recessed central portion, with high stability, to thereby assure accurate positioning of the lens blank relative to the lens blank holder.

The configuration of the lens blank holder, and the shape and number of the at least one air passage are not particularly limited. In a fourth preferred form of the above second aspect of the present invention, the lens blank holder is a cylindrical structure which includes: a mounting portion formed at one of opposite axial ends thereof, and at which the lens blank holder is fixed to the back surface cutting device: the first portion having the tapered holding surface at the other axial end; and the second portion having the at least one air passage which is formed in the axial direction of the lens blank holder and which is open in a central portion of the concave holding surface.

The lens blank holder constructed as described above is fixed at its mounting portion to the spindle of the back surface cutting device through a suitable chucking device.

Accordingly, the lens blank which is held on the concave holding surface of the lens blank holder can be supported by the lens blank holder on the spindle of the back surface cutting device. In the lens blank holder according to the above form of the invention, the air passage or passages is/are open in the central portion of the concave holding surface. Thus, this arrangement permits easy formation of the air passage or passages through which the negative pressure is applied to the lens blank for drawing the lens blank onto the concave holding surface.

The above third object of the present invention may be attained according to a third aspect of the invention, a lens blank holder for holding an intermediate lens blank during a cutting operation on a convex front surface of the lens blank to form a front curved surface of an ocular lens, the intermediate lens blank further having a concave back curved surface which has been formed by cutting, the lens blank holder including a convex holding surface for contact with the lens blank for holding the intermediate lens blank thereon, the lens blank holder being mounted on a front surface cutting device for cutting the convex front surface of the intermediate lens blank, so that the intermediate lens blank is supported on the front surface cutting device, the lens blank holder comprising: a first portion having said convex holding surface which has different radii of curvature at a central portion thereof and an outer peripheral portion thereof, convex holding surface following a profile of the concave back curved surface of the intermediate lens blank; and a second portion having at least one air passage which is open in the convex holding surface, the concave back curved surface of the intermediate lens blank being drawn onto the convex holding surface under a negative pressure applied through the at least one air passage.

In the lens blank holder constructed as described above, the intermediate lens blank is held by and drawn onto the convex holding surface under a negative pressure applied thereto, so that the intermediate lens blank can be easily attached to and removed from the lens blank holder. When the present lens blank holder is mounted on the spindle of the front surface cutting device, the intermediate lens blank is supported by the lens blank holder on the spindle of the cutting device, thereby improving efficiency of the cutting operation on the lens blank for forming the front curved surface of an intended ocular lens.

The convex holding surface of the present lens blank holder, onto which the back surface of the intermediate lens blank is drawn is a curved surface having different curvatures at its central and outer peripheral portions, so that the convex holding surface follows the profile of the concave back curved surface of the intermediate lens blank which has previously been formed. According to this arrangement, the intermediate lens blank is positioned relative to the convex holding surface of the blank holder, and is held in position in pressing contact with the convex holding surface, such that the central portions of the front surface of the lens blank and the convex holding surface of the blank holder are held in contact with each other, and such that the outer peripheral portions of the front surface of the lens blank and the convex holding surface of the blank holder are held in contact with each other. Thus, this arrangement improves the efficiency and accuracy of the cutting operation on the lens blank for forming the front curved surface of the intended ocular lens.

In the present lens blank holder, the intermediate lens blank is drawn directly onto the convex holding surface of the blank holder by application of the negative pressure thereto without a bonding adhesive layer interposed therebetween, permitting accurate positioning of the intermediate lens blank relative to the spindle of the cutting device in the axial direction as well as in the radial direction. Therefore, according to the present arrangement, the thickness of the intermediate lens blank can be precisely controlled, to thereby assure the accuracy of the cutting operation on the lens blank for forming the front curved surface.

The configuration and number of the at least one air passage through which the negative pressure is applied to the lens blank are not particularly limited, provided that each air passage is open in the convex holding surface of the lens blank holder for applying a suction force of the negative pressure to the lens blank which is placed on the convex holding surface. For instance, the at least one air passage is a single air passage which is open in a central portion of the convex holding surface. Alternatively, the at least one air passage may be a single or a plurality of annular slits, or a plurality of arcuate or circular holes which are spaced apart from each other at a suitable interval in the circumferential direction of the convex holding surface. Further, the at least a portion of the above-indicated second portion which is adjacent to the convex holding surface may be formed of a porous metal material, a porous ceramic material or a porous resin material, so as to provide a multiplicity of minute pores of openings which are open in the tapered holding surface. The cross sectional shape of each air passage may be circular, rectangular, or star-shaped, for instance. The location of the opening of each air passage is not particularly limited. However, when the opening is relatively large, it is preferably located at the outer peripheral portion of the convex holding surface, which contacts the outer peripheral portion of the lens blank. Since the outer peripheral portion of the ocular lens to be obtained from the intermediate lens blank has a smaller optical importance than the central portion, the opening is desirably located at the outer peripheral portion of the convex holding surface, for assuring high cutting accuracy by preventing deformation of the lens blank at its central portion which is required to have the desired optical characteristics.

In a first preferred form of the above third aspect of the present invention, the convex holding surface has an annular groove formed at a boundary between the central portion and the outer peripheral portion thereof.

The annular groove formed as described above is effective to accommodate or absorb a misalignment of a point of transition of the radius of curvature in the intermediate lens blank with respect to a point of transition of the radius of curvature in the convex holding surface of the blank holder, which misalignment would be caused by dimensional errors of the convex holding surface and the intermediate lens blank, for instance.

In a second preferred form of the above third aspect of the present invention, the convex holding surface onto which the concave back curved surface of the intermediate lens blank is drawn has a frictional area which is formed of a material having a friction coefficient higher than that of the other area of the convex holding surface, so that the frictional area functions as a fixing surface for preventing displacement of the intermediate lens blank.

According to this arrangement, the frictional area of the convex holding surface functions as the fixing surface. In this case, the above-indicated other area of the convex holding surface is formed of a highly rigid material for holding the intermediate lens blank in a predetermined position while preventing deformation of the intermediate lens blank during the cutting operation. On the other hand, the fixing surface is formed of a material that generates a sufficient friction force to prevent displacement of the intermediate lens blank during the cutting operation, so that the intermediate lens blank is held in position with high stability. This arrangement allows the intermediate lens blank to be kept drawn on the convex holding surface of the lens blank holder with high stability during the cutting operation for forming the front curved surface of the intended ocular lens while preventing deformation of the intermediate lens blank. Accordingly, the obtained ocular lens does not suffer from any deficiencies which arise from otherwise possible deformation and displacement of the intermediate lens blank during the cutting operation, thereby improving cutting accuracy and stability in forming the front curved surface of the ocular lens.

As in the lens blank holder used for the back surface cutting of the lens blank described above, the material of a non-frictional portion of the present lens blank holder, which non-frictional portion gives the above-indicated other area of the convex holding surface, and the material of a frictional portion that gives the frictional area or fixing surface of the convex holding surface are not particularly limited, but are suitably determined by taking account of the formability and the material of the other portions of the lens blank, for example. It is preferable to use, as the material of the non-frictional portion, a highly rigid material such as a metal or a synthetic resin material such as an acrylic resin material which includes PMMA, polystylene, polyester, polycarbonate or ABS resin, for instance. On the other hand, the material of the frictional portion is suitably selected from a synthetic resin material such as a soft vinyl chloride resin, nylon or polyurethane, and an elastic material such as a silicone rubber or a fluoro rubber, all of which have an elastic coefficient lower than the non-frictional portion, and a high friction coefficient to generate a high friction force with respect to the lens blank. For improving productivity and reducing the weight and manufacturing cost of the lens blank holder, it is particularly preferable to use PMMA for the non-frictional portion and the soft vinyl chloride resin for the frictional portion.

In a third preferred form of the above third aspect of the present invention, the fixing surface is located at the outer peripheral portion of the convex holding surface which has a radius of curvature different from that of the central portion.

Generally, the outer peripheral portion of the ocular lens has a smaller optical importance than the central portion. In view of this, the central portion of the intermediate lens blank which is required to exhibit excellent optical characteristics is desirably held in contact with the corresponding central portion of the convex holding surface of the lens blank holder, which central portion is formed of the highly rigid material for the purpose of preventing deformation of the intermediate lens blank, to thereby permit accurate cutting operation on the intermediate lens blank. On the other hand, the outer peripheral portion of the intermediate lens blank which is less likely to effect the optical characteristics of the obtained ocular lens is desirably held in contact with the fixing surface of the convex holding surface, which is formed of a material having a low elastic coefficient and a high friction coefficient, so that the intermediate lens blank is held in position with high stability.

In a fourth preferred form of the above third aspect of the present invention, the lens blank holder is a cylindrical structure which includes: a mounting portion formed at one of opposite axial ends thereof, at which the lens blank holder is fixed to the front surface cutting device; a main body which functions as a part of the first portion and a part of the second portion; and a sleeve member which is formed of a material different from that of the main body and and which is fitted on an axial end portion of the main body remote from the mounting portion, the sleeve member cooperating with the main body to constitute the first and second portions, the outer peripheral portion of the convex holding surface being provided by an axial end face of the sleeve member remote from the mounting portion, and functioning as a fixing surface for preventing displacement of the intermediate lens blank on the convex holding surface, the at least one air passage including at least one opening which is open in the convex holding surface, at an interface between the main body and the sleeve member.

In the lens blank holder constructed according to the above form of the invention, the fixing sleeve is fitted on the main body, permitting a simple cylindrical structure which is easy to assemble. The convex holding surface of the present lens blank holder consists of the central portion provided by the main body having high rigidity, and the outer peripheral portion provided by the fixing sleeve exhibiting an excellent property for retaining the lens blank in position owing to a friction force with respect to the concave back curved surface of the lens blank. In the present arrangement, the air passage or passages is/are easily formed such that at least one groove which is formed in the circumferential surface of one of the main body and the fixing sleeve is closed by the circumferential surface of the other of the main body and the fixing sleeve, so that each groove is open in the convex holding surface, at the interface between the circumferential surfaces of the main body and the sleeve member. The thus constructed lens blank holder can be easily fixed to the spindle of the front surface cutting device by using a suitable chucking device, for instance, whereby the lens blank is advantageously held by the lens blank holder on the spindle of the front surface cutting device.

The above fourth object of the present invention may be attained according to a fourth aspect of the invention, which provides a loading and unloading device for loading and unloading a lens blank which gives an ocular lens, on and from a cutting device for effecting a cutting operation on a front surface or a back surface of the lens blank, the cutting device including a spindle and having a first holding surface provided on the spindle thereof, the lens blank being drawn onto the first holding surface under a negative pressure applied thereto during the cutting operation, the loading and unloading device loading and unloading the lens blank on and from the first holding surface, the loading and unloading device comprising: (a) a sucker having a second holding surface which is opposed to the first holding surface of the cutting device and on which the lens blank is initially held under a negative pressure applied thereto, the sucker and the cutting device being movable relative to each other so that the second holding surface is movable toward and away from the first holding surface; (b) negative pressure controlling means for controlling the negative pressure to be applied to the lens blank, so that the lens blank is loaded on and unloaded from the first holding surface when the first and second holding surfaces are located adjacent to each other; and (c) centering means for aligning axes of the first and second holding surfaces with each other, the centering means having a first tapered annular abutting surface disposed axially adjacent to and radially outwardly of the first holding surface, and a second tapered annular abutting surface disposed axially adjacent to and radially outwardly of the second holding surface, the first and second tapered annular abutting surfaces being abuttable on each other to align the axes of the first and second holding surfaces when the first and second holding surfaces are moved toward each other, the first and second tapered annular abutting surfaces being moved relative to each other during a relative movement of the sucker and the cutting device.

In the loading and unloading device constructed according to the fourth aspect of the present invention, the lens blank held by one of the first and second holding surfaces is transferred to the other of the first and second holding surfaces by removing the negative pressure from the above-indicated one surface and applying the negative pressure to the above-indicated other surface. According to this arrangement, the lens blank can be readily attached to and removed from the holding surface provided on the spindle of the cutting device for cutting the front or back surface of the lens blank, and accordingly the lens blank can be easily loaded on and unloaded from the cutting device with high positioning accuracy. Thus, the ocular lens can be produced with significantly improved efficiency.

The lens blank holders constructed according to the above second and third aspects of the present invention, respectively, and the loading and unloading device constructed according to the above fourth aspect of the invention are preferably used in the method of producing the ocular lens according to the above first aspect of the invention. However, the lens blank holders and the loading and unloading device of the present invention are used in ocular lens producing methods other than the method of the present invention. For example, the present lens blank holders and loading and unloading device may be used where one of the opposite surfaces of the lens blank is subjected to a cutting operation with the other surface being drawn to the spindle of the cutting device by application of a negative pressure thereto, and the other surface is subsequently subjected to a cutting operation with the above-indicated one surface being bonded to a suitable jig. In this case, too, the cutting efficiency and accuracy are significantly improved.

BRIEF DESCRIPTION OF THE DRAWINGS

The above and optional objects, features, advantages and technical significance of the present invention will be better understood by reading the following detailed description of presently preferred embodiments of the invention, when considered in conjunction of the accompanying drawings, in which.

DETAILED DESCRIPTION OF PREFERRED EMBODIMENTS

Figure 1:
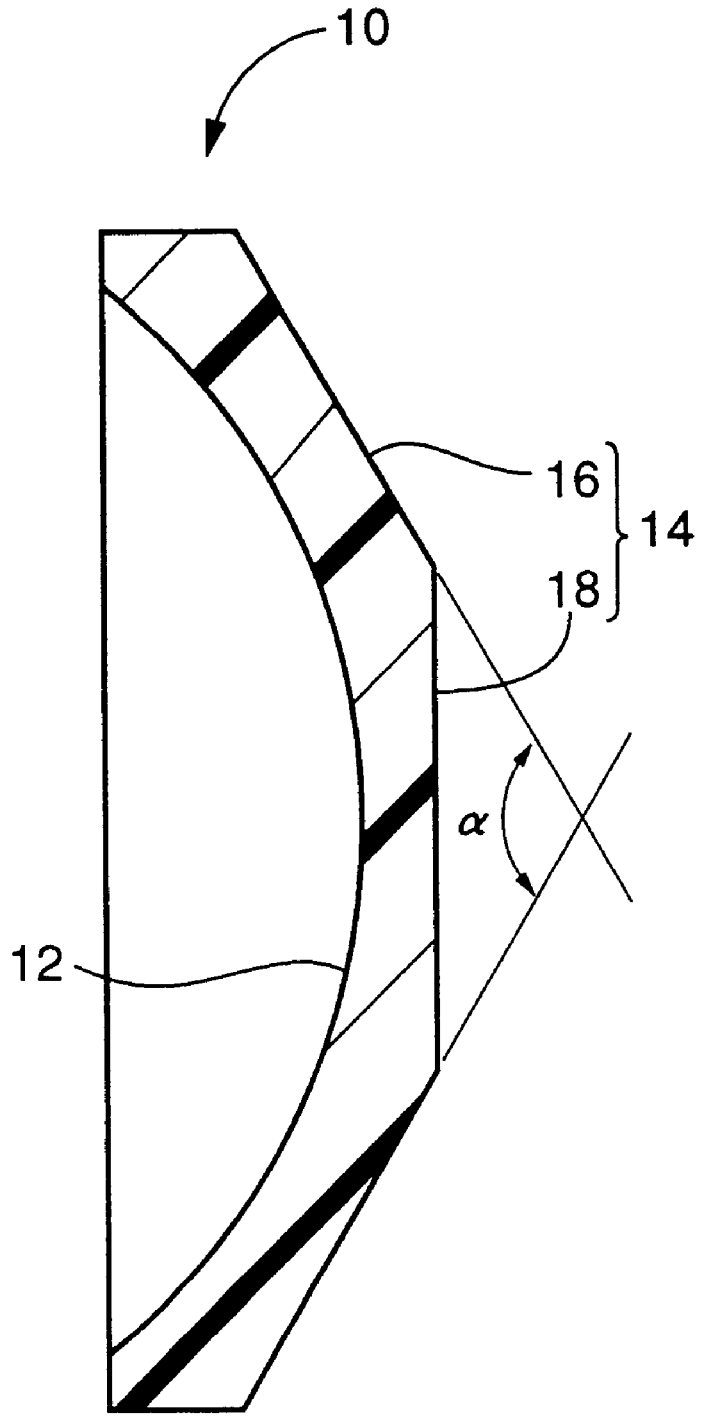
FIG. 1 is an elevational view in axial cross section of a lens blank which is used in the process of producing an ocular lens according to the present invention.

Referring first to FIG. 1, there is shown one example of a lens blank 10 which is used in the present method of producing an ocular lens. This lens blank 10 has a thickness and a diameter which are larger than those of an ocular lens to be obtained therefrom, so that the lens blank 10 gives one intended ocular lens. Described more specifically, the lens blank 10 has a circular shape corresponding to a profile of the intended ocular lens, and a substantially constant thickness. One of the opposite surfaces of the lens blank 10 is a concave back surface 12 and the other surface is a generally convex front surface 14. The back surface 12 has a part-spherical concave shape which substantially follows the profile of the intended ocular lens while the front surface 14 includes: an outer peripheral annular tapered surface 16 whose radial dimension is slightly larger than a half of the diameter of the lens blank 10; and a central flat surface 18 perpendicular to the axis L of the lens blank 10. Although the taper angle $\alpha$ of the tapered surface 16 as shown in FIG. 1 varies depending upon the profile of the ocular lens to be obtained, for instance, the taper angle is preferably selected within a range of 80°–160°, so as to efficiently utilize the lens blank material and permit the lens blank to be fixedly retained or held by a lens blank holder which is used in a back surface cutting operation on the lens blank described below.

The lens blank 10 described above is formed by polymerization of a known monomer liquid which gives a polymer for the intended ocular lens, for instance. Described more specifically, the lens blank 10 is formed by using a mold having a mold cavity which gives the front and back surfaces 12, 14. The monomer liquid is injected into the mold cavity, and then polymerized to thereby provide the lens blank 10 having an intended configuration. The lens blank 10 may be otherwise formed. That is, a cylindrical lens material is first obtained by polymerization of the monomer liquid in a test tube. The obtained cylindrical lens material is then subjected to a turning operation with a suitable depth of cut, so as to reduce its outside diameter, so that a bar-shaped blank having a high degree of cylindricity is obtained. Then, a cut-off tool is fed at an angle relative to the axis of the bar-shaped blank with the blank being rotated about its axis, so that the bar-shaped blank is cut into a plurality of workpieces (lens blanks), each having a tapered convex front surface and a tapered concave back surface. Subsequently, the central portion of the tapered convex surface is removed for providing the flat surface 18, and the tapered concave surface is roughly machined into the part-spherical back surface 12. Thus, the intended lens blank 10 shown in FIG. 1 is obtained. Where the lens blank 10 is obtained by cutting the bar-shaped blank described above, the back surface 12 need not be machined into the part-spherical surface.

Figure 2:
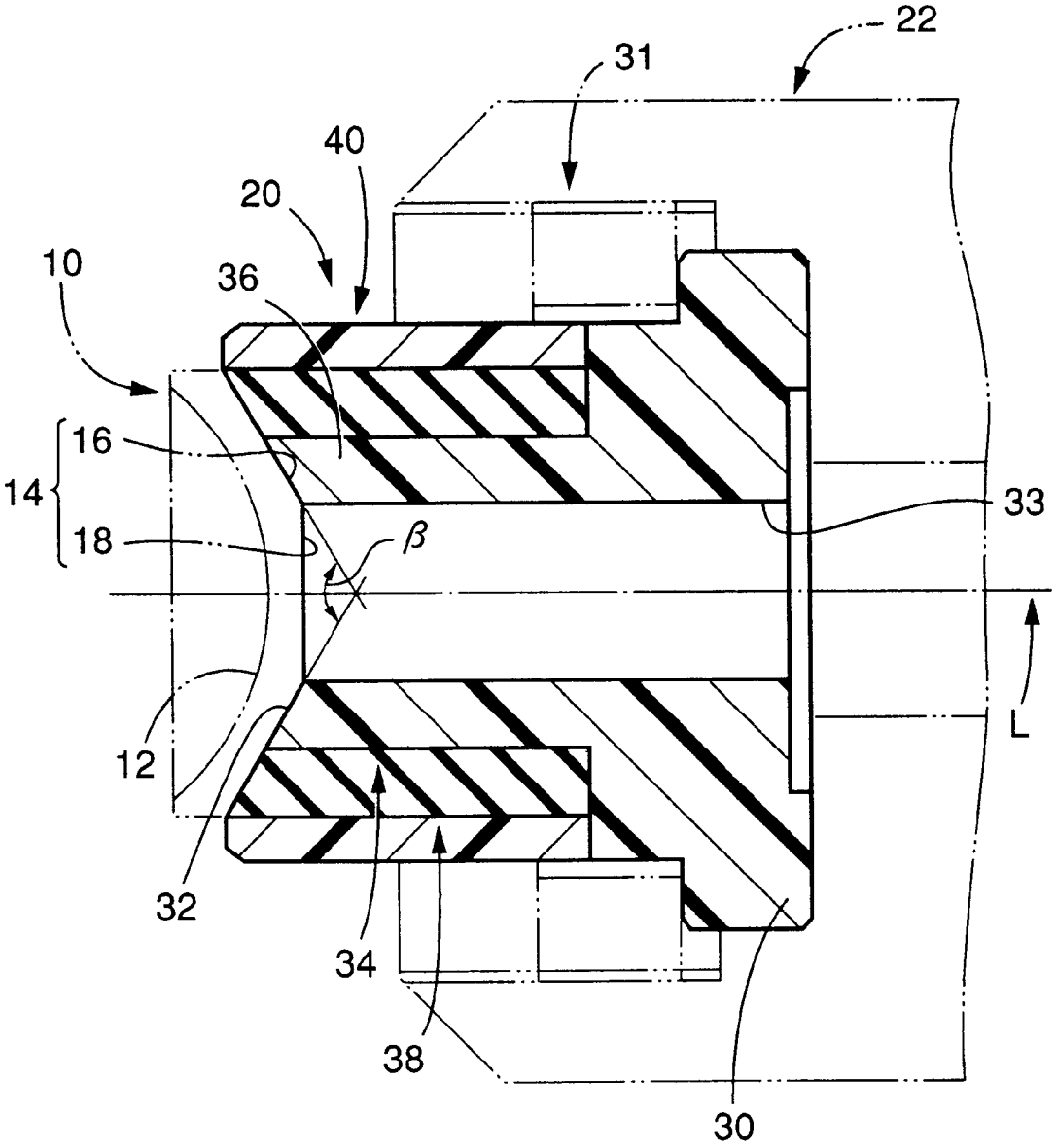
FIG. 2 is an elevational view in axial cross section of a lens blank holder used for a back surface cutting operation on the lens blank of FIG. 1.
Figure 3:
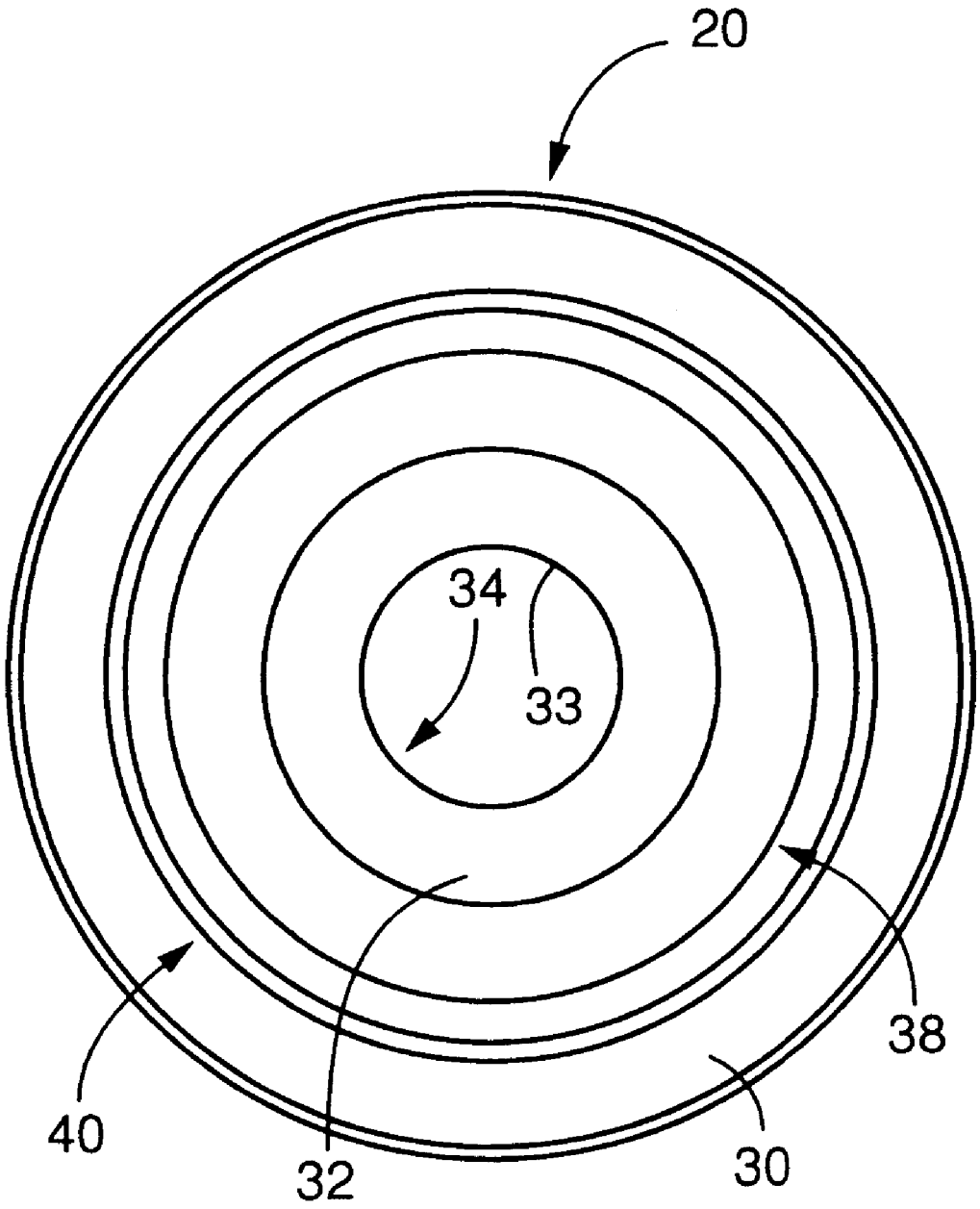
FIG. 3 is a left-side elevation of the lens blank holder of FIG. 2.
Figure 4:
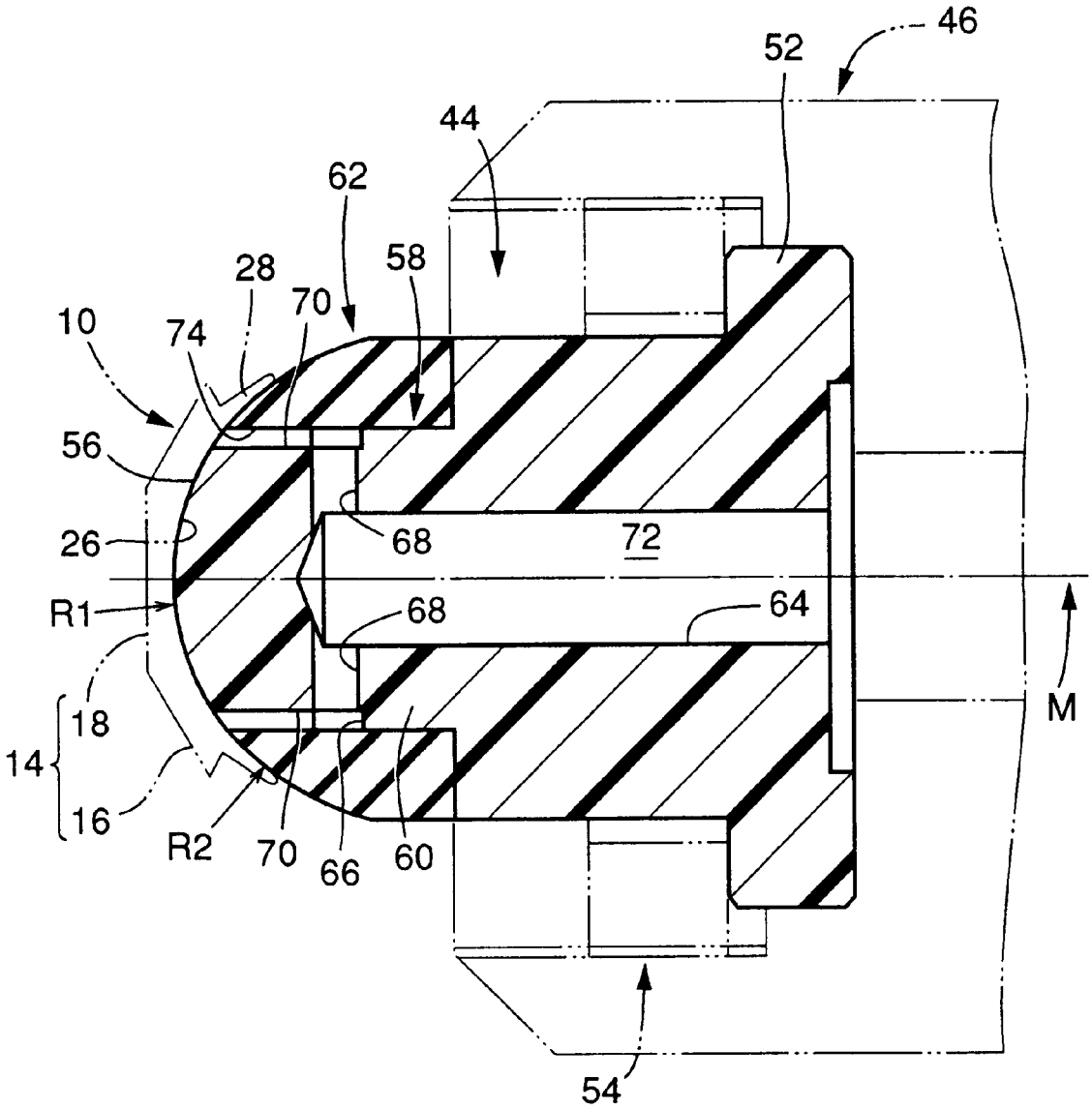
FIG. 4 is an elevational view in axial cross section of a lens blank holder used for a front surface cutting operation on the lens blank of FIG. 1.

For producing the intended ocular lens from the thus obtained lens blank 10, the back surface 12 of the lens blank 10 is first subjected to a cutting operation with the lens blank being supported on a back surface cutting device. In the back surface cutting operation on the lens blank 10, a lens blank holder 20 as shown in FIGS. 2 and 3 is used. More specifically, the lens blank 10 is fixedly supported, at its front surface 14, by the lens blank holder 20 which is clamped on a spindle 22 of the back surface cutting device. Then, a cutting tool is fed relative to the lens blank 10 to cut the back surface 12 into a desired back curved surface 26 as shown in FIG. 4 while the spindle 22 is rotated for rotating the lens blank 10 about its axis L. The cutting tool is replaced with different one as needed after the back curved surface 26 is formed, for forming an edge portion 28 which provides the largest diameter (DIA) of the lens.

The lens blank holder 20 used for the back surface cutting of the lens blank 10 is a cylindrical member having a suitable axial dimension and a circular cross sectional shape. The lens blank holder 20 includes a large-diameter mounting portion 30 located at one of its opposite axial ends. At this mounting portion 30, the lens blank holder 20 is fixedly attached to the spindle 22 of the back surface cutting device via a known chucking device 31 such as a collet chuck, such that the axes of the spindle 22 and the lens blank holder 20 are aligned with each other. The lens blank holder 20 has a concave holding surface 32 at the other axial end thereof remote from the mounting portion 30. The lens blank holder 20 has an air passage 33 formed therethrough in its axial direction, in alignment with its axis, and is open in the central portion of the concave holding surface 32. According to this arrangement, the concave holding surface 32 is an annular surface surrounding the opening of the air passage 33, and the entirety of the annular surface is tapered with its diameter continuously reduced in the axial direction toward the mounting portion 30, to thereby provide the tapered holding surface 32. In the present embodiment, the center of the tapered holding surface 32 lies on the axis of the lens blank holder 20.

The tapered holding surface 32 is formed to fit the tapered surface 16 of the front surface 14 of the lens blank 10. The taper angle $\beta$ of the surface 32 as shown in FIG. 2 is substantially equal to the taper angle $\alpha$ of the tapered surface 16 of the lens blank 10. In this arrangement, upon fixing of the lens blank 10 at the front surface 14 to the tapered holding surface 32 of the lens blank holder 20, the tapered surface 16 of the lens blank 10 can be brought into close contact with the tapered holding surface 32 of the blank holder 20, whereby the axis of the lens blank 10 can be aligned with the axis of the lens blank holder 20.

The lens blank holder 20 has a three-layer structure at the axial end on the side of the concave holding surface 32. Described in detail, the lens blank holder 20 has a small-diameter portion 36 formed at the axial end remote from the large-diameter mounting portion 30, such that these portions 30, 36 are integral with each other and cooperate to constitute a main body 34 of the lens blank holder 20. On this small-diameter portion 36, a fixing sleeve 38 and a protective sleeve 40 each having a cylindrical shape are fitted in this order, and bonded to one another as needed.

The axial end face of the main body 34 cooperates with the axial end face of the fixing sleeve 38 to provide the above-indicated concave holding surface 32. In the present embodiment, the main body 34 and the protective sleeve 40 are formed of a highly rigid material in an attempt to hold the lens blank and prevent the lens blank from being deformed due to an external force applied thereto during the cutting operation. Examples of such a highly rigid material include: a metal material such as an aluminum alloy or a steel; and a hard synthetic resin such as an acrylic resin which includes PMMA, polystyrene, polyester, polycarbonate or an ABS resin. On the other hand, the fixing sleeve 38 is formed of a material having a high friction coefficient so as to generate a large friction force with respect to the lens blank 10, for the purpose of preventing the lens blank 10 from moving out of position. For instance, the fixing sleeve 38 is formed of a soft synthetic resin such as a soft vinyl chloride resin or polyurethane, or an elastic material, which is softer than the material of the main body 34. According to this arrangement, the tapered holding surface 32 which contacts the tapered surface 16 of the lens blank 10 consists of a central portion which is given by the axial end face of the highly rigid main body 34, and an outer peripheral portion which is given by the axial end face of the soft fixing sleeve 38.

The lens blank 10 is supported by the thus constructed lens blank holder 20 on the spindle 22 of the back surface cutting device in the following manner. Initially, the lens blank holder 20 is fixed at its mounting portion 30 to the spindle 22 of the back surface cutting device through a suitable chucking device, for instance. Then, the air passage 33 formed in the lens blank holder 20 is connected to a negative pressure source via an air conduit, so that the front surface 14 of the lens blank 10 is drawn onto the tapered holding surface 32 of the lens blank holder 20 under a negative pressure, such that the tapered surface 16 of the lens blank 10 is held in contact with the tapered holding surface 32, whereby the lens blank 10 is held on the tapered holding surface 32 by the negative pressure applied through the air passage 33.

According to this arrangement, the axis of the lens blank 10 is aligned with the axis of the spindle 22 of the back surface cutting device by the abutting contact of the tapered surface 16 of the lens blank 10 with the tapered holding surface 32 of the lens blank holder 20. Further, the lens blank 10 is prevented from being displaced in the radial direction on the holding surface 32 owing to the pressing contact of the two tapered surfaces 16, 32 with each other. In this arrangement, the central portion of the lens blank 10 is held in contact with the corresponding central portion of the tapered holding surface 32, which central portion is provided by the highly rigid main body 34 so as to prevent deformation of the lens blank 10, while the outer peripheral portion of the lens blank 10 is held in contact with the corresponding outer peripheral portion of the tapered holding surface 32, which portion is provided by the fixing sleeve 38 formed of the material having a high friction coefficient, whereby the lens blank 10 is prevented from moving in the circumferential direction. Thus, the lens blank 10 can be kept in an appropriate position relative to the spindle of the back surface cutting device by the pressing contact of the two tapered surfaces 16, 32 with each other. It is noted that the outer peripheral portion of the tapered holding surface 32 provided by the fixing sleeve 38 functions as an annular fixing surface extending continuously in the circumferential direction of the holding surface 32.

The present lens blank holder 20 permits the lens blank 10 to be easily attached to and removed from the back surface cutting device, and at the same time, to be fixedly supported on the back surface cutting device, so that the cutting operation on the back surface 12 of the lens blank 10 can be effected with high stability and accuracy, resulting in precise and efficient formation of an intended back curved surface 26 of an ocular lens to be produced. The back curved surface 26 has different curvatures at its central portion which is to be placed substantially on the cornea of the eye and gives an effective optical diameter, and at its outer peripheral portion located radially outwardly of the central portion, so as to assure good circulation of the tear fluid between the surfaces of the eye-ball and the ocular lens, when the obtained ocular lens is used as a contact lens. In most cases, the outer peripheral portion of the lens has a radius of curvature which is larger than that of the central portion.

Figure 5:
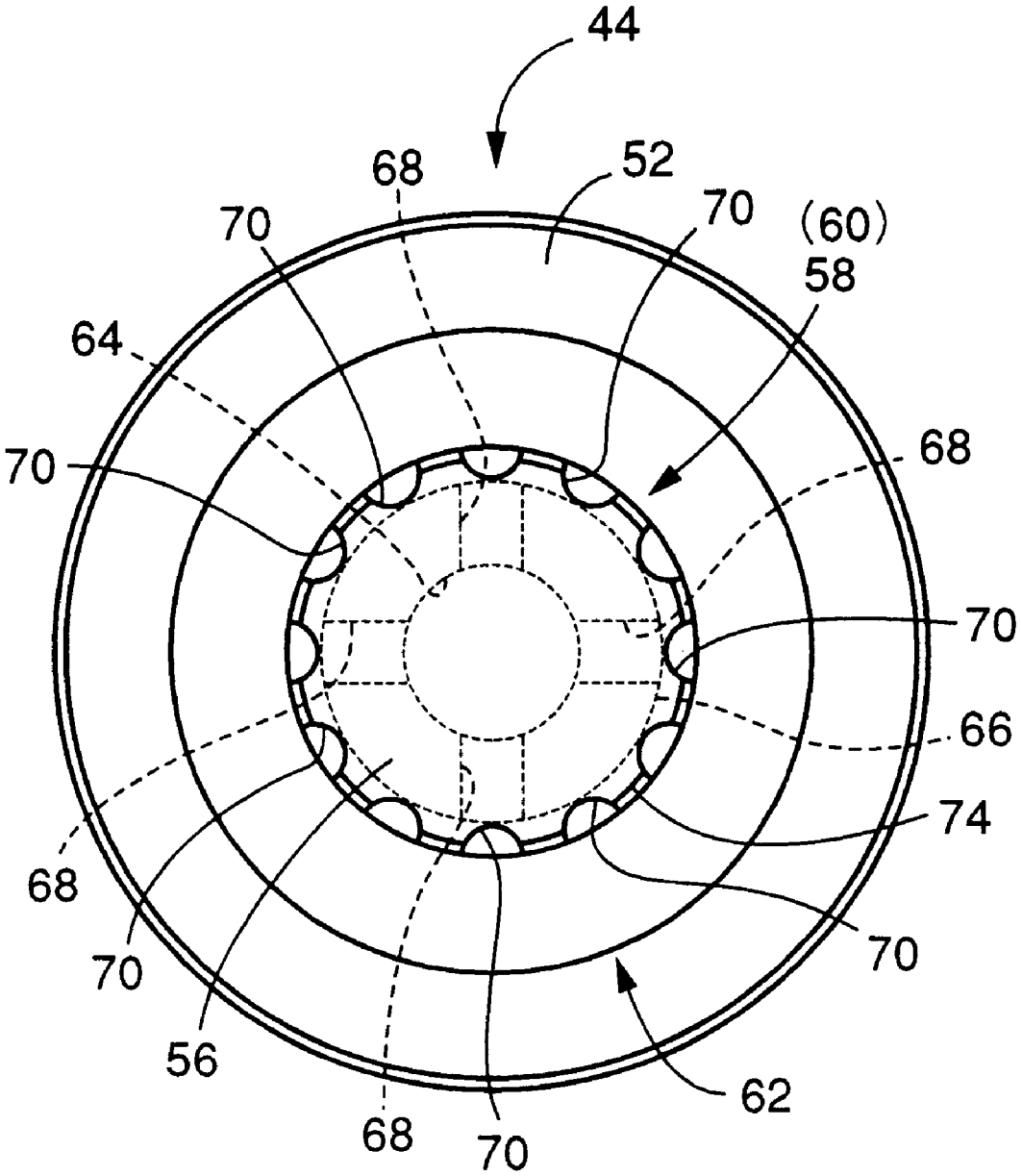
FIG. 5 is a left-side elevation of the lens blank holder of FIG. 4.

After the back surface 12 of the lens blank 10 is cut to form the back curved surface 26, the air passage 33 is disconnected from the negative pressure source to remove the lens blank 10 from the lens blank holder 20. Subsequently, the lens blank 10 is supported on a front surface cutting device for cutting the front surface 14. In the front surface cutting operation of the lens blank 10, a lens blank holder 44 as shown in FIGS. 4 and 5 is used. More specifically, the intermediate lens blank 10 whose back surface 12 has been cut to form the back curved surface 26 is fixedly supported by the lens blank holder 44 on a spindle 46 of the front surface cutting device. Then, a cutting tool is fed relative to the lens blank 10 to cut the front surface 14 into an intended front curved surface of the lens while the spindle 46 is rotated for rotating the lens blank 10 about its axis M.

The lens blank holder 44 used for the front surface cutting of the lens blank 10 is a cylindrical member having a suitable axial dimension and a circular cross sectional shape. The lens blank holder 44 includes a large-diameter mounting portion 52 at one of its opposite axial ends. At this mounting portion 52, the lens blank holder 44 is attached to the spindle 46 of the front surface cutting device via a known chucking device 54 such as a collet chuck, such that the axes of the spindle 46 and the lens blank holder 44 are aligned with each other. The lens blank holder 44 has a convex holding surface 56 at the other axial end remote from the large-diameter mounting portion 52. The convex holding surface 56 has a substantially part-spherical shape and protrudes in the axial direction away from the mounting portion 52.

The lens blank holder 44 has a two-layer structure at the axial end portion on the side of the convex holding surface 56. Described in detail, the lens blank holder 44 has a small-diameter portion 60 formed at the axial end remote from the large-diameter mounting portion 52, such that these portions 52, 60 are integral with each other and cooperate to constitute a main body 58 of the lens blank holder 44. On this small-diameter portion 60, a cylindrical fixing sleeve 62 is fitted, and bonded to each other as needed.

In the present embodiment, the main body 58 is formed of a highly rigid material in an attempt to hold the lens blank 10 and prevent the lens blank 10 from being deformed due to an external force applied thereto during the cutting operation. Examples of such a highly rigid material include: a metal material such as an aluminum alloy or a steel; and a hard synthetic resin such as PMMA or an ABS resin. On the other hand, the fixing sleeve 62 is formed of a material having a high friction coefficient so as to generate a large friction force with respect to the lens blank 10, for the purpose of preventing the intermediate lens blank 10 from moving out of position. For instance, the fixing sleeve 62 is formed of a soft synthetic resin such as a soft vinyl chloride resin or polyurethane, or an elastic material, which is softer than the material for the main body 58.

According to the arrangement described above, the axial end faces of the main body 58 and the fixing sleeve 62 cooperate with each other to provide the convex holding surface 56. In this arrangement, the central portion of the convex holding surface 56 is given by the axial end face of the highly rigid main body 58, while the outer peripheral portion thereof is given by the soft fixing sleeve 62. The thus formed convex holding surface 56 fits the back curved surface 26 of the intermediate lens blank 10. Namely, when the intermediate lens blank 10 is cut at its front surface 14 to form a contact lens whose back curved surface 26 has different curvatures at its central and outer peripheral portions, the back curved surface 26 is brought into contact with the convex holding surface 56 of the lens blank holder 44.

In the present embodiment, the radius of curvature R1 of the central portion of the convex holding surface 56 given by the axial end face of the main body 58 is equal to the radius of curvature of the central portion of the back curved surface 26 of the intermediate lens blank 10. On the other hand, the radius of curvature R2 of the outer peripheral portion of the convex holding surface 56 given by the axial end face of the fixing sleeve 62 is equal to the radius of curvature of the outer peripheral portion of the back curved surface 26 of the intermediate lens blank 10. In this arrangement, the point of transition or change of the radius of curvature on the convex holding surface 56 lies on the boundary between the axial end faces of the main body 58 and fixing sleeve 62. In ordinary contact lenses, the radius of curvature R1 is made smaller than the radius of curvature R2.

The main body 58 has a central hole 64 which extends therethrough in the axial direction from the large-diameter mounting portion 52 toward the small-diameter portion 60, and a circumferential groove 66 which is open in the outer circumferential surface of the small-diameter portion 60. In the main body 58, there are also formed four radial communication holes 68 each of which extends in the radial direction at one of the opposite ends of the central hole 64 remote from the mounting portion 52. These holes 68 are open to the circumferential groove 66, so as to connect the central hole 64 and the circumferential groove 66 with each other. A plurality of axial grooves 70 are formed in the outer circumferential surface of the small-diameter portion 60 of the main body 58, such that the axial grooves 70 extend in the axial direction from the circumferential groove 66 so as to be open in the convex holding surface 56. The axial grooves 70 are spaced apart from each other at a suitable interval in the circumferential direction of the small-diameter portion 60. The circumferential groove 66 and the axial grooves 70 which are formed on the outer circumferential surface of the small-diameter portion 60 of the main body 58 are closed by the inner circumferential surface of the fixing sleeve 62 which is fitted on the main body 58. In the thus constructed lens blank holder 44, the central hole 64, the communication holes 68, the circumferential groove 66 and the axial grooves 70 cooperate with one another to constitute an air passage 72 which is open in the convex holding surface 56. In this arrangement, the air passage 72 has a plurality of openings in the convex holding surface 56 at the axial ends of the axial grooves 70, which openings are aligned along the boundary of the central and outer peripheral portions of the convex holding surface 56, at which the point of transition of the curvature is located. The plurality of openings in the convex holding surface 56 are connected with one another by a circular groove 74 which extends along the boundary of the central portion and the outer peripheral portion of the convex holding surface 56 in the circumferential direction thereof.

The lens blank 10 is supported by the lens blank holder 44 constructed as described above on the spindle 46 of the front surface cutting device in the following manner. Initially, the lens blank holder 44 is fixed at its mounting portion 52 to the spindle 46 of the front surface cutting device through a suitable chucking device, for instance. Then, the air passage 72 is connected to a negative pressure source via an air conduit, so that the back curved surface 26 of the intermediate lens blank 10 is drawn onto the convex holding surface 56 of the lens blank holder 44 under a negative pressure. Thus, the intermediate lens blank 10 is held on the convex holding surface 56 by the negative pressure applied through the air passage 72.

The intermediate lens blank 10 is held by the convex holding surface 56 of the lens blank holder 44, such that the back curved surface 26 is held in close contact with the convex holding surface 56 over the entire surface thereof. In the present embodiment, the convex holding surface 56 of the lens blank holder 44 has different curvatures at its central and outer peripheral portions, so as to conform to the profile of the back curved surface 26 of the intermediate lens blank 10. According to this arrangement, the axis of the intermediate lens blank 10 can be easily aligned with that of the convex holding surface 56, and the intermediate lens blank 10 is positioned relative to the lens blank holder 44 with high accuracy. Further, the intermediate lens blank 10 held on the convex holding surface 56 is prevented from moving out of position.

In the present embodiment, the convex holding surface 56 is provided by the central portion which is given by the axial end face of the main body 58 formed of the highly rigid material described above, and the outer peripheral portion which is given by the axial end face of the fixing sleeve 62 formed of the material having a high friction coefficient. In this arrangement, the central portion of the intermediate lens blank 10 which has a significant influence on the optical characteristics of the ocular lens to be produced is held in contact with the corresponding central portion of the convex holding surface 56 of the lens blank holder 44, which central portion is given by the highly rigid main body 58, so as to prevent the deformation of the intermediate lens blank 10, while the outer peripheral portion of the lens blank 10 which has a relatively small optical importance is held in contact with the corresponding outer peripheral portion of the convex holding surface 56, which portion is given by the fixing sleeve 62 formed of the material having a high friction coefficient, whereby the lens blank 10 is kept in an appropriate position by the pressing contact with the outer peripheral portion of the convex holding surface 56. In this respect, the outer peripheral portion of the convex holding surface 56 which is given by the fixing sleeve 62 functions as an annular fixing surface.

According to the present embodiment, the intermediate lens blank 10 can be easily and quickly attached to and removed from the front surface cutting device via the present lens blank holder 44 constructed as described above. Further, the present lens blank holder 44 permits the lens blank 10 to be fixedly supported on the front surface cutting device, whereby the front surface cutting operation on the intermediate lens blank 10 can be effected with high stability and precision, resulting in precise and efficient formation of an intended front curved surface of the ocular lens.

Figure 6:
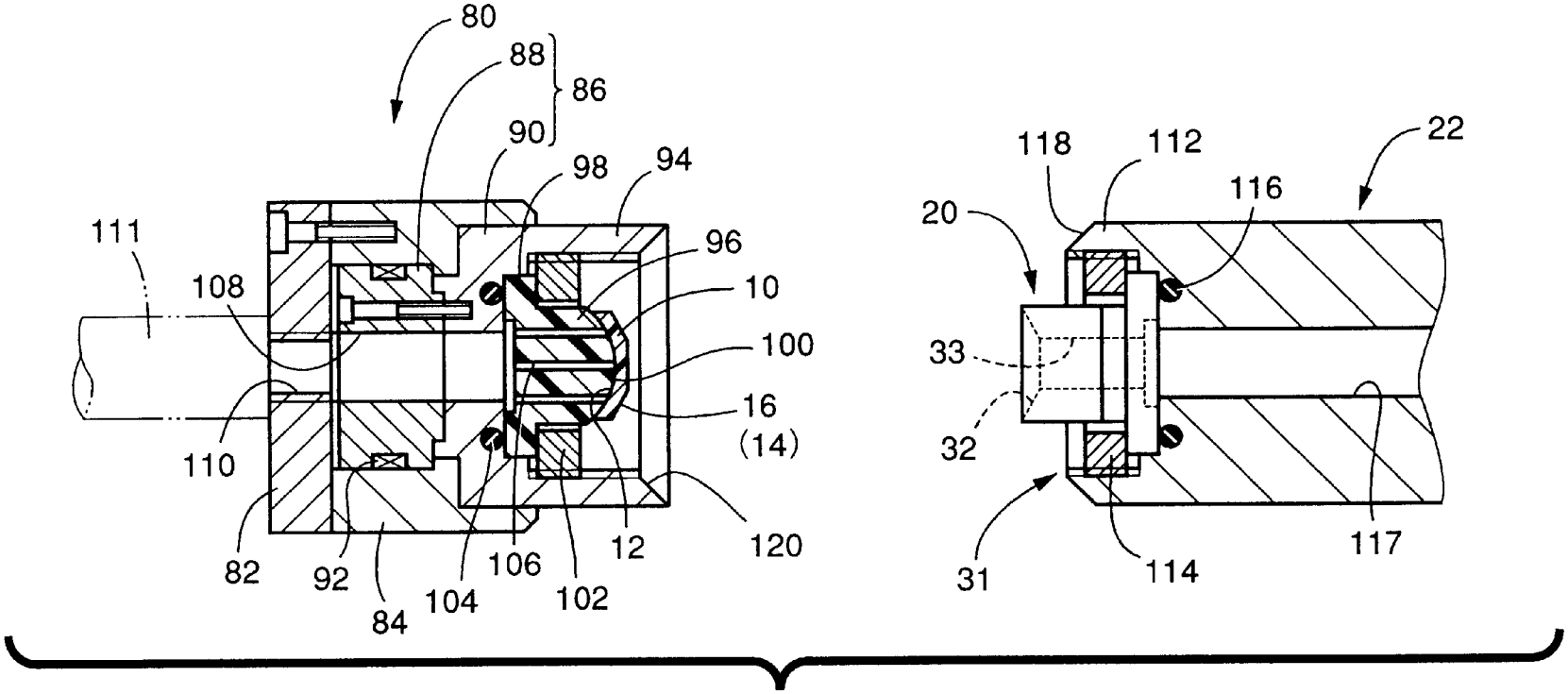
FIG. 6 is an elevational view in axial cross section of a lens blank loading and unloading device for loading and unloading the lens blank on and from the holding surface provided on the spindle of a back surface cutting device.
Figure 7:
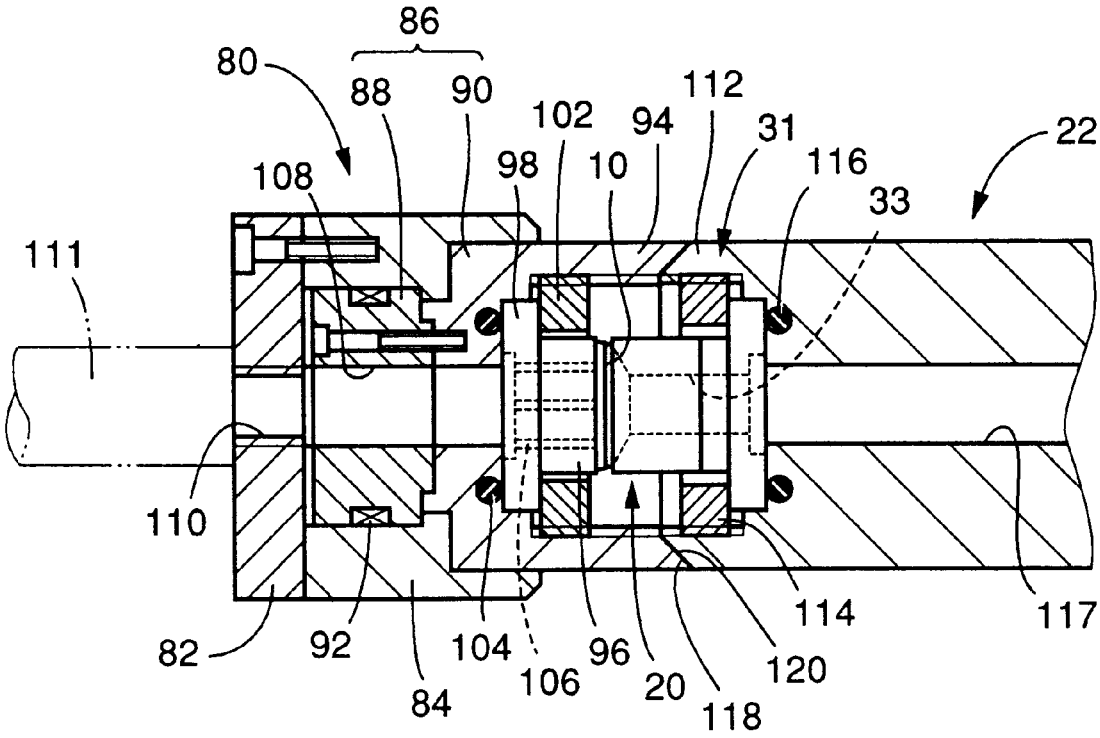
FIG. 7 is an elevational view in axial cross section of the lens blank loading and unloading device of FIG. 6, in an operating state different from that of FIG. 6.

In effecting the cutting operations on the lens blank 10 for forming the intended front and back curved surfaces by using the present lens blank holders 20, 44, a lens blank loading and unloading device 80 (hereinafter referred to as "loader/unloader") as shown in FIGS. 6 and 7 is suitably used for loading the lens blank 10 on the holding surfaces 32, 56 of the lens blank holders 20, 44, and unloading the lens blank 10 therefrom after the cutting operations. There will be next described one example of such a loader/unloader for loading and unloading the lens blank 10 on and from the spindle of the back surface cutting device via the lens blank holder 20 described above.

The loader/unloader 80 includes a planar base member 82 which is opposed to the working end of the spindle 22 of the back surface cutting device. On the base member 82, a cylindrical support member 86 having a relatively large thickness is mounted so as to face the spindle 22. The support member 86 is fixed to the base member 82 via a fixing sleeve 84 which is bolted to the base member 82. This support member 86 consists of a first cylindrical member 88 and a second cylindrical member 90 which are bolted to each other in the axial direction, and is air-tightly fitted in the fixing sleeve 84 via a sealing member 92 interposed therebetween. At one of the opposite axial ends of the support member 86 remote from the base member 82, there is provided a cylindrical protruding portion 94 having a large diameter and extending in the axial direction toward the spindle 22 of the back surface cutting device. Within the cylindrical protruding portion 94, a sucker 96 is accommodated and fixed to the support member 86.

The sucker 96 is a cylindrical member having a circular cross sectional shape, and has an outward flange 98 extending radially outwardly at one of its opposite axial ends on the side of the base member 82, and a convex suction surface 100 at the other axial end, which suction surface 100 is shaped to follow the contour of the back surface 12 of the lens blank 10 to be loaded on the spindle 22. The sucker 96 is fixed at its outward flange 98 functioning as a fixing portion, to the axial end face of the support member 86, by a retainer ring 102 which meshes with an internal thread formed on the inner circumferential surface of the protruding portion 94. The sucker 96 is forced onto the axial end face of the support member 86 via an O-ring 104 interposed therebetween.

The sucker 96 is formed with a plurality of air passages 106 formed therethrough in the axial direction and open in the suction surface 100. These air passages 106 are connected to an inner bore 108 of the support member 86, which is in turn connected to an external air conduit 111 via a connecting hole 110 formed through the base member 82. The air passages 106 are connected to a negative pressure source through the inner bore 108, the connecting hole 110 and the air conduit 111, whereby the back surface 12 of the lens blank 10 is drawn onto the suction surface 100 under a negative pressure applied thereto through the air passages 106.

The loader/unloader 80 constructed as described above is driven by suitable drive means such as a hydraulically or pneumatically operated cylinder, such that it is movable in the axial direction toward and away from the spindle 22 of the back surface cutting device. In this arrangement, when the loader/unloader 80 is moved toward the spindle 22, the lens blank 10 held by the suction surface 100 of the sucker 96 is loaded on the concave holding surface 32 of the lens blank holder 20 that is installed on the spindle 22 of the back surface cutting device.

The spindle 22 of the back surface cutting device on which the lens blank holder 20 is installed has an integral annular support portion 112 at the working end. This support portion 112 has a relatively large diameter and extends in the axial direction so as to face the protruding portion 94 of the loader/unloader 80. Within the support portion 112, the lens blank holder 20 is accommodated and fixed at its mounting portion 30 to the spindle 22, by means of a retainer ring 114 that meshes with an internal thread formed on the inner circumferential surface of the support portion 112. The lens blank holder 20 is forced onto the axial end face of the spindle 22 through an O-ring 116 interposed therebetween. The spindle 22 has a central hole 117 formed therethrough in the axial direction and connected to the air passage 33 of the lens blank holder 20, so that the lens blank 10 is drawn onto the concave holding surface 32 of the lens blank holder 20 under the negative pressure applied through the central hole 117 and the air passage 33.

The loader/unloader 80 has centering means for aligning the axes of the suction surface 100 of the sucker 96 and the concave holding surface 32 of the lens blank holder 20 with each other. Described more specifically, the centering means is constituted by an axial end face 120 of the protruding portion 94 functioning as a first annular abutting surface, and an axial end face 118 of the support portion 112 functioning as a second annular abutting surface. These first and second annular abutting surfaces 118, 120 are in mutually facing relationship with each other in the axial direction, and are adapted to be held in abutting contact with each other when the loader/unloader 80 is moved to the spindle 22.

The first abutting surface 120 of the protruding portion 94 is tapered with its inside diameter continuously reduced in the axial direction in which the loader/unloader 80 is moved away from the spindle 22, while the second abutting surface 118 of the support portion 112 is tapered with its outside diameter continuously reduced in the same axial direction as indicated above. The taper angle of the first and second abutting surfaces 120, 118 is determined such that these first and second abutting surfaces 120, 118 are held in close contact with each other when the loader/unloader 80 is moved to the spindle 22. The axis of the tapered abutting surface 120 of the protruding portion 94 is aligned with the axis of the suction surface 100 of the sucker 96, while the axis of the tapered abutting surface 118 of the support portion 112 is aligned with the axis of the concave holding surface 32 of the lens blank holder 20.

The lens blank 10 is loaded onto the concave holding surface 32 of the lens blank holder 20 installed on the spindle 22 of the back surface cutting device, by using the present loader/unloader 80, in the following manner. Initially, the loader/unloader 80 opposed to the spindle 22 of the back surface cutting device is spaced from the spindle 22 by a suitable axial distance therebetween, shown in FIG. 6. Then, the connecting hole 110 of the loader/unloader 80 is connected to the negative pressure source, so as to suck the lens blank 10 onto the suction surface 100 of the sucker 96. In this state, the loader/unloader 80 is moved toward the spindle 22 of the cutting device, until the first abutting surface 120 of the protruding portion 94 of the loader/unloader 80 abuts on the second abutting surface 118 of the support portion 112 of the spindle 22. The loader/unloader 80 may be moved toward the spindle 22 for the abutting contact of the first and second abutting surfaces 120, 118 while one or both of the loader/unloader 80 and the spindle 22 is/are rotated about their axes. When the spindle 22 is adapted to rotate, the support member 86 and the sucker 96 of the loader/unloader 80 may be rotatably supported by the fixing sleeve 84 about its axis, by means of bearings, for instance. In this case, the support member 86 and the sucker 96 are rotated with the spindle 22 when the first and second abutting surfaces 120, 118 abut on each other.

With the first abutting surface 120 of the protruding portion 94 and the second abutting surface 118 of the support portion 112 being held in abutting contact with each other, the central hole 117 of the spindle 22 is connected to the negative pressure source for applying the negative pressure to the lens blank 10 through the central hole 117 and the air passage 33. At the same time, the connecting hole 110 of the loader/unloader 80 is disconnected from the negative pressure source and brought into communication with the atmosphere. According to this arrangement, the lens blank 10 held on the suction surface 100 of the loader/unloader 80 is loaded onto the concave holding surface 32 of the lens blank holder 20, and is held thereon by suction of the negative pressure applied through the central hole 117 and the air passage 33. For smoothly loading and unloading the lens blank 10 on and from the concave holding surface 32 of the lens blank holder 20 installed on the spindle 22, and reducing an impact on the lens blank 10 which would be caused by the abutting contact of the lens blank 10 with the concave holding surface 32 or the suction surface 100 when the lens blank 10 is loaded on or unloaded from the concave holding surface 32 by the negative pressure applied thereto, the axial distance between the suction surface 100 of the loader/unloader 80 and the concave holding surface 32 of the lens blank holder 20 when the first abutting surface 120 of the protruding portion 94 and the second abutting surface 118 of the support portion 112 are held in abutting contact with each other, is determined such that the axial distance between the front or back surface of the lens blank 10 held by one of the suction surface 100 and the concave holding surface 32, and the other of the suction surface 100 and the concave holding surface 32 on which the lens blank 10 is to be loaded is about 0.1 mm.

In the present arrangement, the tapered first abutting surface 120 of the protruding portion 94 and the tapered second abutting surface 118 of the support portion 112 are formed coaxially with the concave holding surface 32 and the suction surface 100, on which the lens blank is held by suction of the negative pressure. According to this arrangement, when the first and second abutting surfaces 120, 118 abut on each other, the axes of the concave holding surface 32 and the suction surface 100 can be aligned with each other. Therefore, when the lens blank 10 held on the suction surface 100 is loaded onto the concave holding surface 32, the axis of the lens blank 10 is aligned with that of the concave holding surface 32. The lens blank 10 thus loaded onto the concave holding surface 32 can be subjected to the cutting operation for forming the back curved surface 26 of the intended ocular lens with high accuracy, without an additional step of aligning the lens blank 10 with the lens blank holder 20. For aligning the axes of the concave holding surface 32 and the suction surface 100 with each other by the abutting contact of the first and second abutting surfaces 120, 118 described above, it is desirable that the loader/unloader 80 be supported such that it is displaceable relative to the spindle 22 in the radial direction over a small distance when the first and second abutting surfaces abut on each other.

By using the suckers 96 having respective different suction surfaces, the loader/unloader 80 of the present invention can be used throughout the process of producing the ocular lens, e.g., a) when the lens blank 10 is unloaded from the spindle 22 of the back surface cutting device after the formation of the back curved surface 26; b) when the lens blank 10 unloaded from the spindle 22 of the back surface cutting device is subsequently loaded onto the spindle of the front surface cutting device after the lens blank is turned over, and c) when the lens blank 10 is unloaded from the spindle of the front surface cutting device after the formation of the front curved surface. In particular, the lens blank 10 whose back surface 12 has been cut to form the back curved surface 26 can be easily and promptly attached to the spindle of the front surface cutting device with high positioning accuracy, for effecting the cutting operation on the thus produced intermediate lens blank 10 to form the front curved surface.

While the present invention has been described in detail in its presently preferred embodiments, it is to be understood that the invention is not limited to the details of the illustrated embodiments, but may be embodied with various changes, modifications and improvements, which may occur to those skilled in the art, without departing from the spirit and scope of the invention defined in the attached claims.

In the present method of producing an ocular lens wherein the lens blank is supported on the spindle of the front or back surface cutting device by suction of the negative pressure applied thereto, the lens blank can be easily and quickly attached to and removed from the spindle, thereby improving production efficiency of the ocular lens. In particular, the lens blank is supported on the spindle of the back surface cutting device in such a manner that the tapered surface of the lens blank fits the tapered holding surface provided on the spindle of the cutting device, whereby the lens blank can be accurately positioned relative to the cutting device and retained in position with high stability, so as to improve the working accuracy. Moreover, the lens blank is directly held on the holding surface provided on the spindle of the cutting device, without a bonding adhesive layer interposed therebetween, whereby the thickness of the lens blank can be easily and accurately adjusted to a desired value of an intended ocular lens.

In the present lens blank holder used for the back surface cutting operation on the lens blank, the front surface of the lens blank is held directly on the tapered holding surface of the lens blank holder under the negative pressure applied thereto, so that the lens blank can be positioned relative to the cutting device with high accuracy, and retained in an appropriate position with high stability, to thereby improve the accuracy and efficiency of the cutting operation on the lens blank for forming the back curved surface of the ocular lens.

In the present lens blank holder used for the front surface cutting operation on the lens blank, the substantially entire area of the back surface of the lens blank, which has been cut to form the back curved surface of the intended ocular lens is held directly on the holding surface of the lens blank holder under the negative pressure applied thereto, so that the intermediate lens blank can be retained in an appropriate position with high stability, to thereby improve the accuracy and efficiency of the cutting operation on the lens blank for forming the front curved surface of the ocular lens.

The loader/unloader constructed according to the present invention is used in combination with the cutting device adapted to hold the lens blank on the holding surface provided on the spindle by application of the negative pressure to the lens blank. According to this arrangement, the lens blank can be smoothly loaded on and unloaded from the cutting device. Thus, the lens blank can be easily and quickly attached to and removed from the cutting device with high positioning accuracy, to thereby significantly improve the productivity of the ocular lens.

What is claimed is:

1. A method of producing an ocular lens, comprising the steps of:

preparing a lens blank which gives an ocular lens, said lens blank having a concave back surface and a convex front surface, at least a portion of said front surface being frusto-conical;

forming a back curved surface of said ocular lens by effecting a cutting operation on said concave back surface of said lens blank, while said lens blank is supported On a spindle of a back surface cutting device such that said frusto-conical portion of said lens blank is drawn onto a tapered holding surface of said spindle under a negative pressure applied to said lens blank, said tapered holding surface following a profile of said frusto-conical portion of said lens blank; and forming a front curved surface of said ocular lens by effecting a cutting operation on said front surface of said lens blank whose back surface has been cut to form said back curved surface, while said lens blank is supported on a spindle of a front surface cutting device such that said back curved surface of said lens black is drawn onto a holding surface of said spindle of said front surface cutting device under a negative pressure applied to said lens blank.

2. A method according to claim 1, wherein said lens blank includes a flat surface formed at a central portion of said front surface thereof, which flat surface is perpendicular to an axis of said lens blank.

3. A method according to claim 1, wherein a taper angle of said frusto-conical portion of said lens blank is in a range of 80°–160°.

4. A lens blank holder for holding a lens blank which gives an ocular lens during a cutting operation on a concave back surface of said lens blank to form a back curved surface of said ocular lens, said lens blank further having a convex front surface at least a portion of which is frusto-conical, said lens blank holder having a concave holding surface for contact with said front surface of said lens blank for holding said lens blank thereon, said lens blank holder being mounted on a back surface cutting device for cutting said concave back surface of said lens blank, so that said lens blank is supported on said back surface cutting device, said lens blank holder comprising:

a first portion having a frusto-conical holding surface which gives at least a portion of said concave holding surface and which follows a profile of said frusto-conical surface of said convex front surface of said lens blank, said lens blank being positioned relative to said lens blank holder such that said frusto-conical surface of said lens blank contacts said frusto-conical holding surface of said lens blank holder; and a second portion having at least one air passage which is open in said concave holding surface, said convex front surface of said lens blank being drawn onto said concave holding surface under a negative pressure applied through said at least one air passage.

5. A lens blank holder according to claim 4, wherein said concave holding surface for contact with said convex front surface of said lens blank has a frictional area which is formed of a material having a friction coefficient higher than that of the other area of said concave holding surface, so that said frictional area functions as a fixing surface for preventing displacement of said lens blank.

6. A lens blank holder according to claim 5, wherein said fixing surface is located at an outer peripheral portion of said concave holding surface.

7. A lens blank holder according to claim 4, wherein said concave holding surface includes a recessed central portion, and said frusto-conical holding surface which surrounds said recessed central portion contacts said front surface of said lens blank.

8. A lens blank holder according to claim 4, wherein said lens blank holder is a cylindrical structure which includes: a mounting portion formed at one of opposite axial ends thereof, and at which said lens blank holder is fixed to said back surface cutting device: said first portion having said frusto-conical holding surface at the other axial end; and said second portion having said at least one air passage which is formed in the axial direction of said lens blank holder and which is open in a central portion of said concave holding surface.

9. A lens blank holder for holding an intermediate lens blank during a cutting operation on a convex front surface of said lens blank to form a front curved surface of an ocular lens, said intermediate lens blank further having a concave back curved surface which has been formed by cutting, said lens blank holder including a convex holding surface for contact with said lens blank for holding said intermediate lens blank thereon, said lens blank holder being mounted on a front surface cutting device for cutting said convex front surface of said intermediate lens blank, so that said intermediate lens blank is supported on said front surface cutting device, said lens blank holder comprising:

a first portion having said convex holding surface which has different radii of curvature at a central portion thereof and an outer peripheral portion thereof, said convex holding surface following a profile of said concave back curved surface of said intermediate lens blank; and a second portion having at least one air passage which is open in said convex holding surface, said concave back curved surface of said intermediate lens blank being drawn onto said convex holding surface under a negative pressure applied through said at least one air passage;

wherein said convex holding surface has an annular groove formed at a bound a between said central portion and said outer peripheral portion thereof.

10. A lens blank holder according to claim 9, wherein said convex holding surface onto which said concave back curved surface of said intermediate lens blank is drawn has a frictional area which is formed of a material having a friction coefficient higher than that of the other area of said convex holding surface, so that said frictional area functions as a fixing surface for preventing displacement of said intermediate lens blank.

11. A lens blank holder according to claim 10, wherein said fixing surface is located at said outer peripheral portion of said convex holding surface which has a radius of curvature different from that of said central portion.

12. A lens blank holder according to claim 9, wherein said lens blank holder is a cylindrical structure which includes: a mounting portion formed at one of opposite axial ends thereof, at which said lens blank holder is fixed to said front surface cutting device; a main body which functions as a part of said first portion and a part of said second portion; and a sleeve member which is formed of a material different from that of said main body and and which is fitted on an axial end portion of said main body remote from said mounting portion, said sleeve member cooperating with said main body to constitute said first and second portions, said outer peripheral portion of said convex holding surface being provided by an axial end face of said sleeve member remote from said mounting portion, and functioning as a fixing surface for preventing displacement of said intermediate lens blank on said convex holding surface, said at least one air passage including at least one opening which is open in said convex holding surface, at an interface between said main body and said sleeve member.

13. A loading and unloading device for loading and unloading a lens blank which gives an ocular lens, on and from a cutting device for effecting a cutting operation on a front surface or a back surface of said lens blank, said cutting device including a spindle and having a first holding surface provided on said spindle thereof, said lens blank being drawn onto said first holding surface under a negative pressure applied thereto during said cutting operation, said loading and unloading device loading and unloading said lens blank on and from said first holding surface, said loading and unloading device comprising:

a sucker having a second holding surface which is opposed to said first holding surface of said cutting device and on which said lens blank is initially held under a negative pressure applied thereto, said sucker and said cutting device being movable relative to each other so that said second holding surface is movable toward and away from said first holding surface;

negative pressure controlling means for controlling said negative pressure to be applied to said lens blank, so that said lens blank is loaded on and unloaded from said first holding surface when said first and second holding surfaces are located adjacent to each other; and centering means for aligning axes of said first and second holding surfaces with each other, said centering means having a first tapered annular abutting surface disposed axially adjacent to and radially outwardly of said first holding surface, and a second tapered annular abutting surface (120) disposed axially adjacent to and radially outwardly of said second holding surface, said first and second tapered annular abutting surfaces being abuttable on each other to align said axes of said first and second holding surfaces when said first and second holding surfaces are moved toward each other, said first and second tapered annular abutting surfaces being moved relative to each other during a relative movement of said sucker and said cutting device.

14. A loader and unloader according to claim 13, wherein said sucker has at least one air passage open in said second holding surface for applying said negative pressure to said lens blank.

15. A loader and unloader according to claim 13, wherein said first and second holding surfaces are axially spaced apart from each other when said first and second tapered abutting surfaces are held in abutting contact with each other, such that an axial distance between said front or back surfaces of said lens blank held by one of said first and second holding surfaces, and the other of said first and second holding surfaces is about 0.1 mm.

16. A lens blank holder for holding a lens blank which gives an ocular lens during a cutting operation on a concave back surface of said lens blank to form a back curved surface of said ocular lens, said lens blank further having a convex front surface at least a portion of which is tapered to give a tapered surface, said lens blank holder having a concave holding surface for contact with said front surface of said lens blank for holding said lens blank thereon, said lens blank holder being mounted on a back surface cutting device for cutting said concave back surface of said lens blank, so that said lens blank is supported on said back surface cutting device, said lens blank holder comprising:

a first portion having a tapered holding surface which gives at least a portion of said concave holding surface and which follows a profile of said tapered surface of said convex front surface of said lens blank, said lens blank being positioned relative to said lens blank holder such that said tapered surface of said lens blank contacts said tapered holding surface of said lens blank holder; and a second portion having at least one air passage which is open in said concave holding surface, said convex front surface of said lens blank being drawn onto said concave holding surface under a negative pressure applied through said at least one air passage;

wherein said concave holding surface for contact with said convex front surface of said lens blank has a frictional area which is formed of a material having a friction coefficient higher than that of the other area of said concave holding surface, so that said frictional area functions as a fixing surface for preventing displacement of said lens blank.

17. A lens blank holder according to claim 16, wherein said fixing surface is located at an outer peripheral portion of said concave holding surface.

18. A lens blank holder for holding a lens blank which gives an ocular lens during a cutting operation on a concave back surface of said lens blank to form a back curved surface of said ocular lens, said lens blank further having a convex front surface at least a portion of which is tapered to give a tapered surface, said lens blank holder having a concave holding surface for contact with said front surface of said lens blank for holding said lens blank thereon, said lens blank holder being mounted on a back surface cutting device for cutting said concave back surface of said lens blank, so that said lens blank is supported on said back surface cutting device, said lens blank holder comprising:

a first portion having a tapered holding surface which gives at least a portion of said concave holding surface and which follows a profile of said tapered surface of said convex front surface of said lens blank, said lens blank being positioned relative to said lens blank holder such that said tapered surface of said lens blank contacts said tapered holding surface of said lens blank holder; and a second portion having at least one air passage which is open in said concave holding surface, said convex front surface of said lens blank being drawn onto said concave holding surface under a negative pressure applied through said at least one air passage;

wherein said concave holding surface includes a recessed central portion, and said tapered holding surface which surrounds said recessed central portion contacts said front surface of said lens blank.

19. A lens blank holder for holding an intermediate lens blank during a cutting operation on a convex front surface of said lens blank to form a front curved surface of an ocular lens, said intermediate lens blank further having a concave back curved surface which has been formed by cutting, said lens blank holder including a convex holding surface for contact with said lens blank for holding said intermediate lens blank thereon, said lens blank holder being mounted on a front surface cutting device for cutting said convex front surface of said intermediate lens blank, so that said intermediate lens blank is supported on said front surface cutting device, said lens blank holder comprising:

a first portion having said convex holding surface which has different radii of curvature at a central portion thereof and an outer peripheral portion thereof, said convex holding surface following a profile of said concave back curved surface of said intermediate lens blank; and a second portion having at least one air passage which is open in said convex holding surface, said concave back curved surface of said intermediate lens blank being drawn onto said convex holding surface under a negative pressure applied through said at least one air passage;

wherein said convex holding surface onto which said concave back curved surface of said intermediate lens blank is drawn has a frictional area which is formed of a material having a friction coefficient higher than that of the other area of said convex holding surface, so that said frictional area functions as a fixing surface for preventing displacement of said intermediate lens blank.

20. A lens blank holder according to claim 19, wherein said fixing surface is located at said outer peripheral portion of said convex holding surface which has a radius of curvature different from that of said central portion.

* * * * *